US005668358A

United States Patent [19]

Wolf et al.

[11] Patent Number: 5,668,358

[45] Date of Patent: Sep. 16, 1997

[54] RECONFIGURABLE KEYBOARD

[75] Inventors: Paul Charles Wolf, Spencerport; Raymond John Stein, Phelps, both of N.Y.

[73] Assignee: Ultimate Rechnology Corporation, Victor, N.Y.

[21] Appl. No.: 679,933

[22] Filed: Jul. 15, 1996

Related U.S. Application Data

[63] Continuation of Ser. No. 271,070, Jul. 5, 1994, abandoned.

[51] Int. Cl.[6] ..... H01H 13/70

[52] U.S. Cl. ..... 200/5 A; 200/345

[58] Field of Search ..... 200/5 R, 5 A, 200/16 R, 16 A, 16 C, 18, 510–517, 341, 344, 345

[56] References Cited

U.S. PATENT DOCUMENTS

| | | | |
|---|---|---|---|
| 4,475,832 | 10/1984 | Wachs | 400/496 |
| 4,529,849 | 7/1985 | Kamei et al. | 200/5 A |
| 4,553,009 | 11/1985 | Van Zeeland et al. | 200/340 |
| 4,574,171 | 3/1986 | Denley | 200/340 |
| 4,771,146 | 9/1988 | Suzuki et al. | 200/340 |
| 4,773,780 | 9/1988 | Hochgesang | 400/472 |
| 4,803,362 | 2/1989 | Butts | 250/229 |
| 4,827,243 | 5/1989 | Cheng | 341/22 |
| 4,830,526 | 5/1989 | Hosono | 400/490 |
| 4,855,548 | 8/1989 | Curley et al. | 200/345 |
| 4,918,271 | 4/1990 | Deeg | 200/344 |
| 5,144,103 | 9/1992 | Suwa | 200/344 |
| 5,172,990 | 12/1992 | Weng | 400/490 |
| 5,204,511 | 4/1993 | Baitz et al. | 235/145 R |
| 5,209,588 | 5/1993 | Chen | 400/490 |
| 5,247,143 | 9/1993 | Suwa | 200/517 |
| 5,268,545 | 12/1993 | Bruner | 200/345 |

*Primary Examiner*—Michael L. Gellner
*Assistant Examiner*—Michael A. Freidhofer
*Attorney, Agent, or Firm*—Cumpston & Shaw

[57] ABSTRACT

A reconfigurable keyboard includes at least two key switches which each has a plunger housing projecting from a top surface thereof, and a multi-switch key cap engageable with the key switch and having at least one dimension that is sufficient to span the at least two key switches. The key cap includes one active switch post to which a plunger is attached, the plunger being reciprocally movable in the plunger housing of one key switch for actuating the key switch when the key cap is depressed, and at least one passive switch post which is also reciprocally movable in the plunger housing of another key switch without actuating the switch when the key cap is depressed. The key cap is selectively positionable anywhere on the keyboard in either a horizontal or a vertical direction. Each key switch further includes four openings each of which are located in a corner of the top surface of the key switch. The openings are symmetric with respect to a diagonal line intersecting opposite corners of the key switch surface and accommodate the selective vertical or horizontal engagement of a clip in two key switch surfaces for retaining a key leveling torsion bar connected to the multi-switch key cap, corresponding to the selective orientation of the key cap on the keyboard.

8 Claims, 3 Drawing Sheets

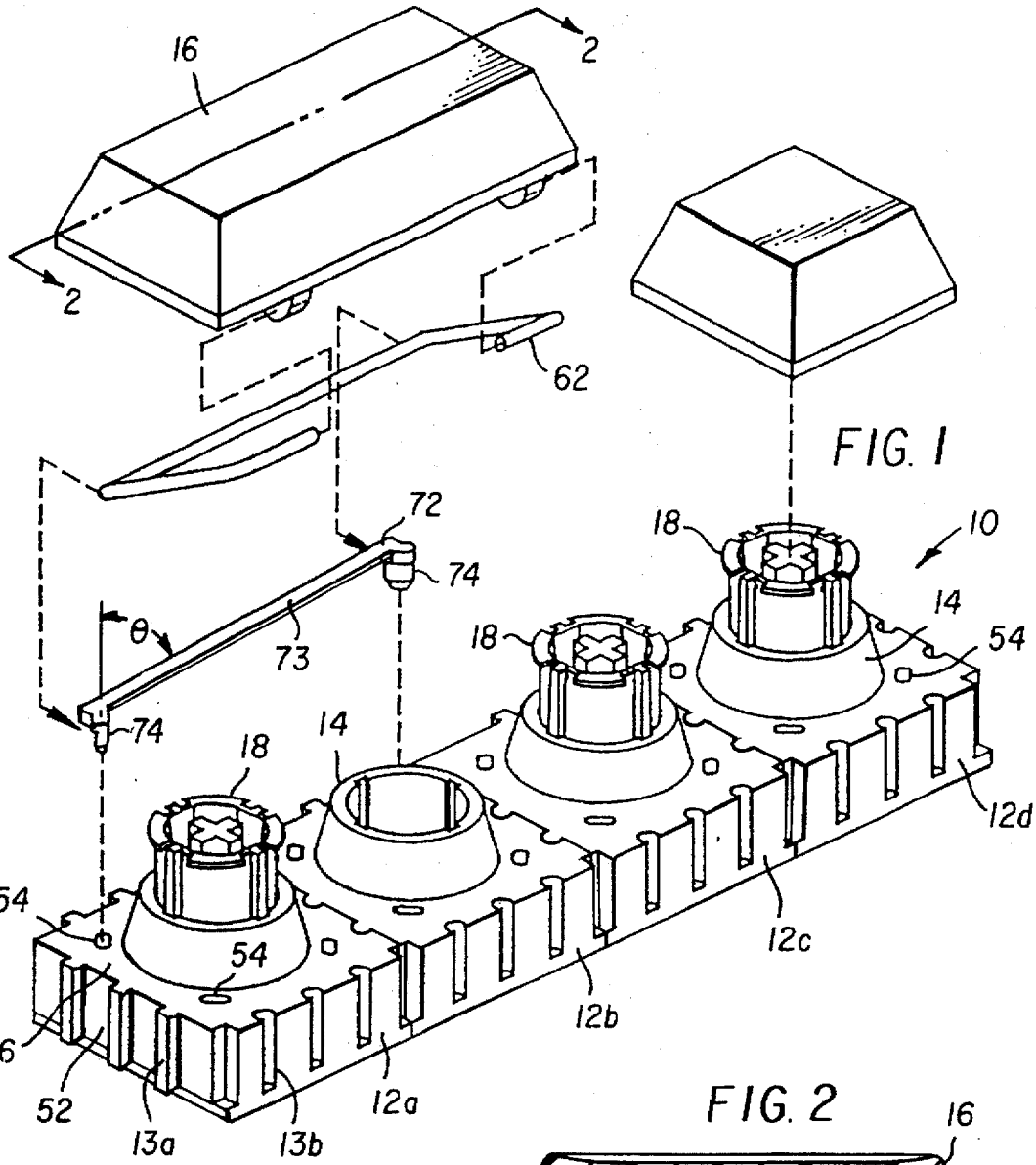
FIG. 1
FIG. 2
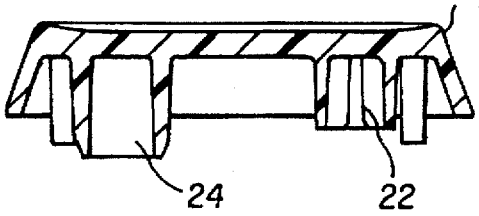
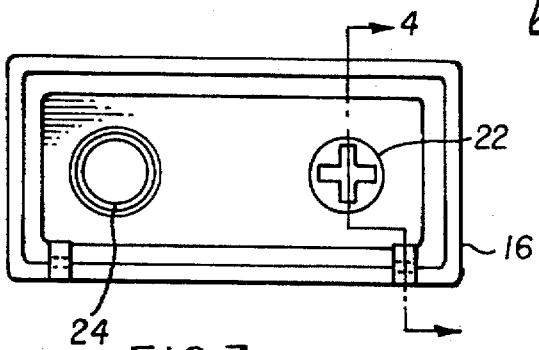
FIG. 3
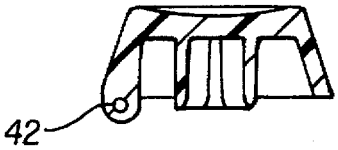
FIG. 4

RECONFIGURABLE KEYBOARD

This application is a continuation of application(s) Ser. No. 08/271,070 filed on Jul. 5, 1994, now abandoned.

FIELD OF THE INVENTION

This invention relates generally to a keyboard, and in particular to a reconfigurable keyboard in which the size, position and orientation of the key caps are selectable at the time of assembly or at the point of use.

BACKGROUND OF THE INVENTION

Keyboards are a primary component of various types of data management systems. In point of sale applications, for instance, a keyboard is typically connected to a computer and serves as the instruction center for sales transactions.

Keyboards generally comprise an array of key switches (switches) located on a circuit board under a corresponding matrix of key caps (keys) which actuate a corresponding switch contact when a key is depressed. From a manufacturing perspective, a regular, rectangular row by column array of switches, each of which switches corresponds to a key, is preferred. Such an array is not optimum in all situations. For example, it may be desirable to provide one or more oversize keys such as a space bar and/or a return key, that cover or span more than one switch. Heretofore, all but one of the corresponding switches in the array under the multi-switch key would be removed from the switch array because it is undesirable to actuate more than a single switch when a key is depressed, regardless of whether the key dimensions correspond to a single switch or multiple switches.

Users of keyboards may prefer a customized key array suited to a particular application; for example, a fast food restaurant manager may prefer a point of sale keyboard in which high volume items can be rung up by pressing respective double wide keys which identify a particular product, and which are arranged and positioned on the keyboard for fast and easy access during busy times. As products and/or sales patterns change, so will the preferred keyboard layout. Typical known keyboards are configured so that either the switch array is specific to a particular key layout, or as mentioned above, multiple switches will be actuated when a single, multi-switch key is pressed. This makes it difficult or impossible for a user to reconfigure the arrangement of the keys.

The inventor has thus recognized a need for a keyboard in which multi-switch keys are mechanically coupled to multiple switches, but actuate only one switch when depressed; and which is reconfigurable with keys of various size, at any desired location on the keyboard, and which can be oriented in either a horizontal or a vertical direction, as best fits the user's needs, at the time of assembly or the point of use and in a convenient and cost efficient manner.

An associated concern with the user configurable keyboard as described herein arises from the desire that the multi-switch key cap remain level when it is depressed regardless of where on the key surface pressure is exerted. Torsion bars are known in the art for effectively distributing the force applied to a multi-switch key cap; however, the selectable position and orientation of multi-switch keys afforded by the invention presents a previously unforeseen problem with respect to accommodating a change in the torsion bar orientation and that of any associated structure upon reconfiguration. Accordingly, the inventor has recognized a need for the ability to reconfigure the torsion bar position and orientation to correspond to the size, orientation and position of the key caps.

SUMMARY OF THE INVENTION

It is an object of the invention to provide a reconfigurable keyboard that incorporates a regular array of key switches, in which a plurality of unit size key caps is interchangeable with one or more multi-switch key caps for configuring the keyboard as desired.

It is another object of the invention to provide a reconfigurable keyboard as described herein in which one or more multi-switch key caps can be selectively positioned on the keyboard and oriented in a vertical or a horizontal direction as desired.

It is a further object of the invention to provide a reconfigurable keyboard as described herein which includes a means for selectively reconfiguring the leveling structure of a multi-size key cap corresponding to the selective orientation and position of the multi-size key cap upon reconfiguration.

In accordance with the invention, a reconfigurable keyboard comprises at least two key switches, each of which includes a plunger housing; and a key cap having at least one dimension sufficient to span the at least two key switches, including one active switch post for receiving a plunger which is reciprocally movable in the plunger housing of one key switch for actuating the switch when the key cap is depressed, and at least one passive switch post which is reciprocally movable in the plunger housing of at least one different key switch without actuating the switch when the key is depressed, wherein the key cap can be positioned anywhere on the keyboard and oriented in a horizontal or vertical direction at the point of use as desired.

The plunger housing on each key switch is a truncated cone having a cylindrical inside wall having at least one groove oriented longitudinally in the wall. A cylindrical plunger is attached to the active switch post of the key cap and includes a rib running longitudinally along the exterior of the plunger which engages the groove. An array of switch contacts are located under the key switches and are each in alignment with a corresponding plunger housing. Each switch contact is covered by a resilient boot, as is well known in the art, which among other things provides an upward bias against the plunger to allow reciprocal motion of the plunger and key cap. The one or more passive switch posts on the multi-switch key cap are also each aligned with a plunger housing for reciprocal motion therein, but are not of a sufficient size to actuate a switch contact when the key cap is depressed.

The invention further comprises means for selectively positioning and orienting a torsion bar retainer clip for engaging a portion of a key leveling torsion bar attached to a multi-switch key, in movable proximity with at least one key switch surface, corresponding to the selective orientation and position of the multi-switch key cap on the keyboard. Each oversized key cap is adapted to pivotally retain the ends of a conventional torsion bar, as is shown in the accompanying drawings. Torsion bars are used in connection with multi-size key caps to keep the key substantially level regardless of where on the key surface pressure is applied. A clip, or other suitable means, is used for engaging a portion of the torsion bar in movable proximity with at least one key switch surface when the key is depressed and released.

In one embodiment of the invention, the means for selectively positioning and orienting the torsion bar retainer clip comprises an array of openings in the surface of the key switch assembly. The openings are adapted to receive the ends of a torsion bar retainer clip. Furthermore, the openings are each located substantially in a corner of the top surface of each switch assembly, and are symmetrical with respect to both the horizontal and the vertical direction; i.e., each opening will accommodate an end of a retainer clip regardless of the vertical or horizontal orientation of the clip on the key switch surfaces. Since a multi-switch key cap spans more than one switch, one end of a torsion bar retainer clip engages one opening in a single switch assembly only, the other end engaging an opening in a horizontally or vertically adjacent switch surface.

In a preferred aspect of this embodiment, the openings are slots which are oriented diagonally with respect to the come surface of each switch assembly, or, in other words, each slot has a longitudinal axis that is substantially parallel to a line tangent to the plunger housing. The ends of the retainer clip are likewise oriented diagonally to the elongate body portion of the clip so that the clip ends can each engage a slot in two key switches in the horizontal direction or the vertical direction corresponding to the orientation of the key cap and its accompanying torsion bar.

It will be appreciated that the openings are not limited to slots, as any symmetrical opening will suffice provided that the ends of the retainer clip are of a complimentary cross sectional shape.

It will further be appreciated that the means for engaging the torsion bar retainer clip is not limited to openings per se, but may include one or more projecting structures such as hooks or catches, for example.

In another embodiment, a torsion bar retainer may be integral with each key switch assembly, it being essential only that the structure provide for the selective orientation and position of the torsion bar of each accompanying multi-switch key cap.

These and other objects and advantages of the invention will become more apparent in view of the drawings and the detailed description of the invention which follow.

DESCRIPTION OF THE DRAWINGS

FIG. 1 is an exploded perspective view of a representative row or column section of reconfigurable keyboard;

FIG. 2 is a side cross sectional view of the double-switch keycap of FIG. 1 through section 2—2, showing the one active switch post and one passive switch post projecting from an underside of the keycap;

FIG. 3 is a bottom plan view of the keycap of FIG. 2;

FIG. 4 is a side cross sectional view of the keycap of FIG. 3 through section 4—4, showing the attachment means of the torsion bar to the keycap;

DETAILED DESCRIPTION OF THE INVENTION

Figure 5:
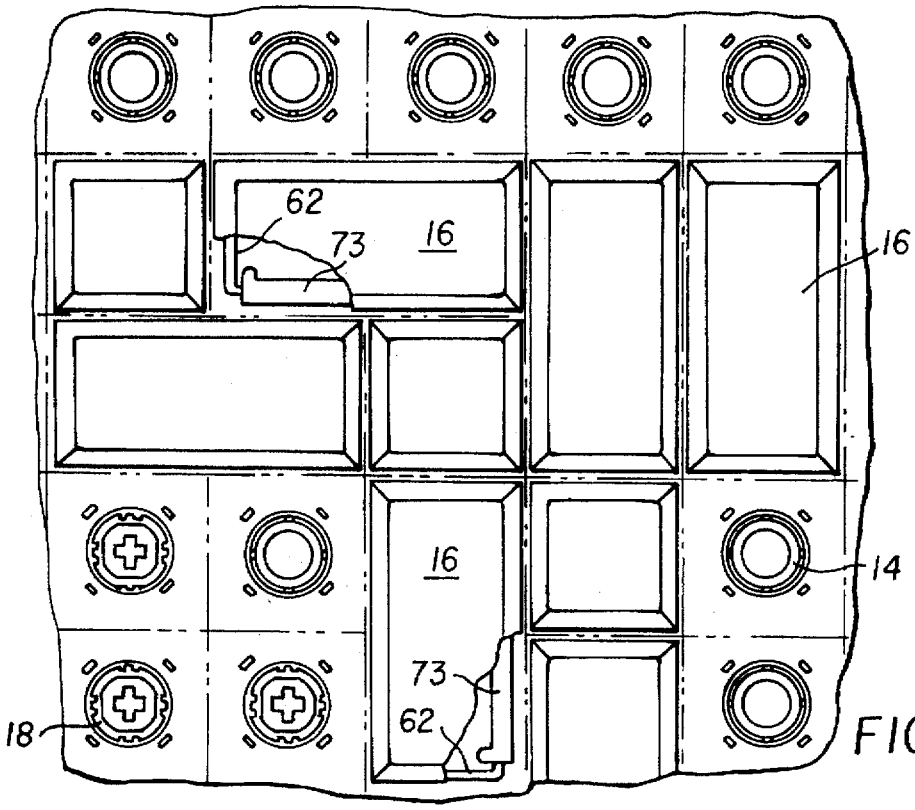
FIG. 5 is a top plan view of a representative section of the reconfigurable keyboard showing several double-switch key caps oriented in the horizontal and vertical directions, and showing in cutaway the corresponding orientation of the accompanying torsion bar retainer clips.
Figure 6:
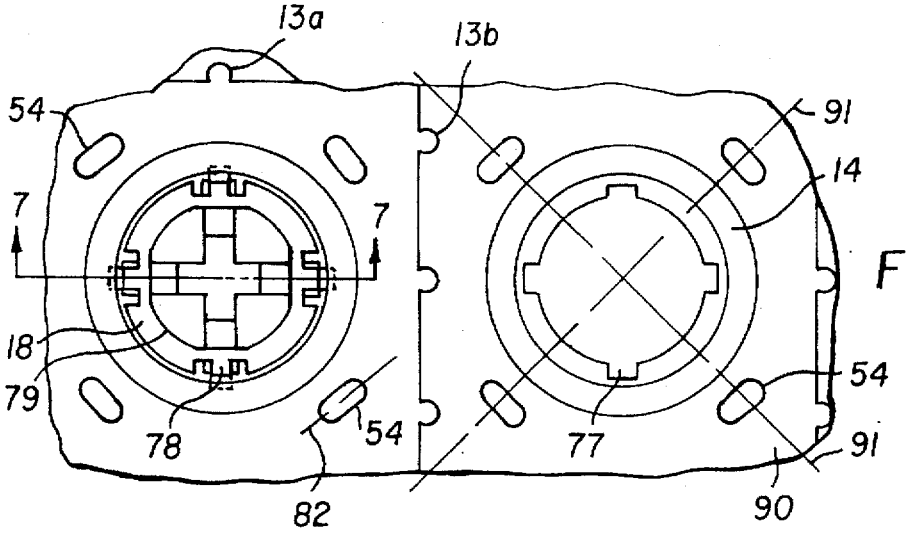
FIG. 6 is a top plan view of two adjacent key switch assemblies of FIG. 5 showing an unoccupied plunger housing and a plunger housing containing a plunger, and also showing the torsion bar retainer clip slot array on the top surface of the switch assemblies.
Figure 7:
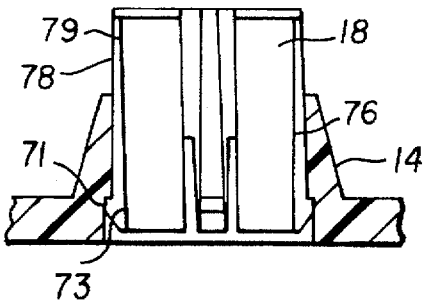
FIG. 7 is a cross sectional view of the plunger housing and plunger of FIG. 6 through section 7—7 showing detents in the housing for engaging a portion of the plunger ribs.

As shown initially in FIGS. 1 and 2, a reconfigurable keyboard 10 comprises at least two identical key switch assemblies **12*a*, 12*b*, each of which includes a base portion 52 having a top surface 56 and a plunger housing 14 projecting from the top surface thereof. With further reference to FIG. 6, each base portion includes a plurality of projections 13*a* along two adjacent side faces thereof, and a plurality of complementary shaped recesses 13*b*** along two other adjacent side faces thereof which allow for the at least two key switch assemblies to be interlocked in rows and/or columns as desired.

Referring to FIGS. 1, 3, 6 and 7, the plunger housing 14 is preferably an annular, truncated cone which projects from the top surface 56 of the key switch base 52. The invention does not limit the shape of the plunger housing, and other shapes such as square, or other symmetrical polygon shapes, or the like, can be used. The purpose of the plunger housing is to reciprocally receive a plunger attached to, or forming a part of, the active switch post of the key cap. As described more fully below and with reference to FIG. 8, a resilient boot 93 covers each switch contact 92 centered below each plunger housing on a printed circuit board. The boot projects into the open base of the housing, and the raised circumference of the boot provides a biasing surface within the housing which maintains the plunger 18 and key cap 16 in a normally up, switch open position. As shown, the inside wall 76 of the plunger housing 14 is cylindrical and has at least one keyway, or groove, 77 which runs longitudinally in the wall. A detent 71 is located in the lowest part of the groove. The plunger 18, which has a cross sectional shape complementary to the cross sectional opening of the housing and to the perimeter of the boot, includes at least one key, or rib, 78 which projects longitudinally from the outside wall 79 of the plunger, and which corresponds to and engages the at least one groove 77. Each rib has a wing 70 at the lowest part of the rib which engages the detent 71 in the groove so that the plunger is not pushed out of the housing by the upward bias of the boot. Slight pressure applied to the outside wall of the plunger will permit the disengagement of the wings from the detent so that the plunger can be removed from the housing if desired. Although the actual shapes of the at least one groove 77 and the at least one rib 78 are not critical, only insofar that they be complementary for sliding engagement, the relative placement of the grooves within the housing is important. Since the orientation of the key cap can be horizontal or vertical, the grooves 77 are located such that they align with the ribs of the plunger when the orientation of the key cap is changed between the horizontal and the vertical direction.

In a preferred embodiment as shown in FIG. 6, four grooves 77 are symmetrically oriented in the housing and are aligned with the row by column orientation of the key switches, and four ribs 78 are symmetrically located around the outside wall of the plunger. In this manner, rotation of the plunger in 90° increments will always allow each rib 78 to align with a complementary groove 77, thereby accommodating the selective horizontal or vertical orientation of the key cap.

In conjunction with the key switch and plunger described above, a multi-switch key cap 16, having either a length or a width or both sufficient to span at least two adjacent key switches includes one active switch post 22 which projects from an underside of the key cap 16 for receiving a plunger, and at least one passive switch post 24 projecting from an underside of the key cap. Regardless of the orientation of the key cap, the active switch post and the at least one passive switch post always align with a corresponding plunger housing. The active switch post 22 has a cylindrical outside wall over which the plunger 18 fits, while the cross sectional shape of the inside wall, shown as a cross in FIG. 3, is complementary to plunger structure 19 projecting from within the plunger, which the switch post telescopically receives. The plunger is preferably securely attachable and detachable from the active switch post and, as such, the actual shape of the interlocking plunger and switch post structures are not critical. The length of the plunger is such that when the plunger is attached to the active switch post, the bottom surface of the plunger is in contact with the perimeter of the resilient boot, and the key cap is biased in a normal, ready position.

Each passive switch post also has a cross sectional shape complementary to the cross sectional opening of the plunger housing, and having a diameter allowing it to freely reciprocate within a plunger housing when the key cap is depressed and released. The passive switch posts assist in guiding the key cap motion, however the length of the passive switch post is insufficient to actuate the switch contact when the key cap is fully depressed. In a preferred embodiment, the annular perimeter of the boot has a diameter greater than the outside diameter of the passive switch post such that there is no interaction between the passive switch post and the resilient boot when the key cap is depressed.

Notwithstanding the embodiments described, it is the combination of an active switch post and at least one passive switch post on a single, multi-size key cap, and the ability of the at least two key switches to accommodate the key cap in either a horizontal or a vertical direction, that is an essential feature of the invention. To this extent, particular characteristics as to the shape of the switch posts or the plunger are a matter manufacturing convenience.

Another feature of the inventions allows for the selective engagement of a torsion bar retainer clip 72 in either a horizontal or a vertical direction on the key board for retaining a portion of a torsion bar 62 connected to the oversize key cap, corresponding to the key cap orientation. Torsion bars are known in the art for effectively leveling an oversize key cap so that it reciprocates evenly over two or more key switches. As shown in FIGS. 1, 4 and 8, a torsion bar 62 pivotally attaches at its ends to a multi-switch key cap 16 by the engagement of each end with a hole 42 in a portion of the key cap. The body of the torsion bar is oriented substantially parallel to the long dimension of the key cap and rests on the surfaces 56 of adjoining key switch assemblies when a key cap is engaged with the keyboard. A retainer clip 72 having ends 74 and a body portion 73 disposed therebetween, engages two switch assemblies 12*a* and 12*b*, for example, by reason of each clip end 74 being received in an opening 54 in each of two switch assemblies. The openings 54 in the top surface 56 of each key switch assembly 12 are located substantially at each corner 90 in each switch assembly surface in an array surrounding the plunger housing 14; and each opening 54 is symmetric with respect to an intersecting, diagonal line 91 through the corner of each switch assembly surface 56, as shown in FIG. 6. The switch assembly surfaces 56 and the retainer clip body 73 provide surfaces for loosely retaining the torsion bar body when the key cap is depressed, as shown in FIG. 8. As long as the retainer openings 54 are symmetric in the sense described above, and the cross sectional shape of the retainer clip ends 74 are complimentary to the shape of the openings, the retainer clip 72 can be selectively oriented in either a horizontal or a vertical direction corresponding to the orientation of the multi-switch key cap and accompanying torsion bar.

In an aspect of the preferred embodiment, as illustrated diagrammatically in FIG. 6, each key switch assembly has four retainer slots 54 arranged in a matrix around plunger housing 14 such that each slot 54 is located intermediate a corner section 90 of the key switch assembly. Accordingly, a longitudinal axis 82 passing through the slot is parallel to a line tangent to the perimeter of the plunger housing 14. The orientation and location of the slots 54, and the diagonal orientation of retainer clip ends 74 with respect to retainer clip body 73, permit the engagement of retainer clip 72 with two key switch assemblies in either a horizontal or a vertical direction corresponding to the direction of the key cap as chosen by the user. Although the invention as illustrated shows a double wide keycap and the torsion bar retaining clip engaging two adjacent key switch assemblies, the invention is not limited merely to double wide keycaps and, as such, each end 74 of the retainer clip may engage a retainer slot 54 in two key switch assemblies which are not immediately adjacent if the key cap spans more than two key switch assemblies.

Figure 8A:
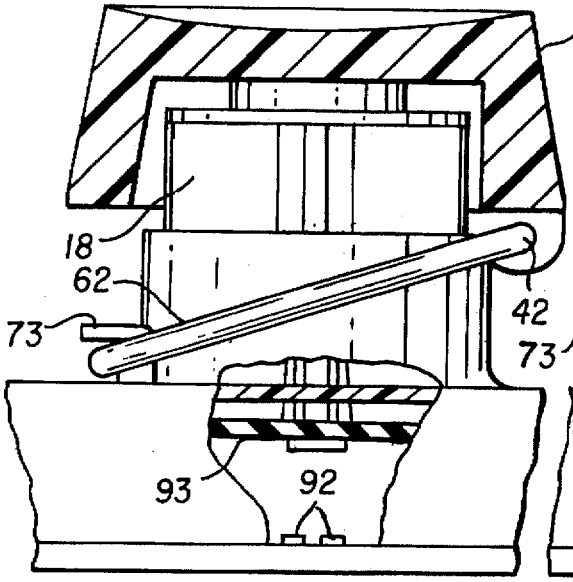
FIG. 8A–8B are representative side elevational, cross sectional views of two adjacent keycaps showing the relationship between the torsion bar and the torsion bar retainer clip when the key cap is in the non depressed state and in the depressed state for actuating a switch contact.
Figure 8B:
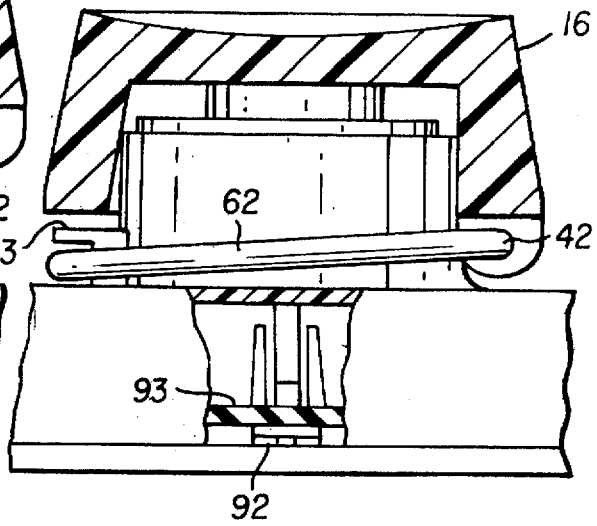

FIG. 8 illustrates the principles of operation of the invention, wherein a carbon button 95 is located on a bottom side of a flexible, resilient boot 93 which overlies printed switch contacts 92, and which is in alignment with each plunger housing. The resiliency of the boot 93 biases the keycap in the up position, as shown in FIG. 8*a*. Downward pressure on the keycap collapses the boot and allows the plunger on the active switch post to push the carbon button into contact with the circuit traces and close the switch, as shown in FIG. 8*b*. The one or more passive switch posts 24 of each multi-size keycap have a length sufficiently short such that upon depression of the keycap, the passive switch posts reciprocate in their respective plunger housings for guiding the key cap motion, but do not allow the carbon button to contact the circuit traces. Since each keycap has only one active switch post to which a plunger attaches, the same switch can be activated when the key cap is positioned either horizontally or vertically on the keyboard without actuating neighboring switches. In this way, the keyboard is reconfigurable. Furthermore, multi-size keycaps operate more smoothly when the keys are leveled by the use of torsion bars. The ability to freely reconfigure the orientation of the torsion bar retainer clip corresponding to the keycap orientation results in full user configurability of the keyboard.

It will be understood by persons having ordinary skill in the art that the invention as described herein above is merely exemplary, and it is to be understood that slight changes and modifications are wholly within the scope of the invention as described in the appended claims.

We claim:

1. A reconfigurable keyboard, comprising:

at least two key switches each including a truncated conical plunger housing projecting from a top surface of each of the key switches, and having a cylindrical inside wall and at least one groove in the wall; and a key cap selectively engageable with the at least two key switches, having at least one dimension sufficient to span the at least two key switches, including one active switch post including a plunger having at least one rib for slidably engaging the groove, which is reciprocally movable in the plunger housing of a first key switch of the key switches for actuating the first key switch, and at least one passive switch post, which is reciprocally movable in the plunger housing of a second key switch of the key switches without actuating said second key switch;

a torsion key pivotally connected to the key cap;

a torsion bar retainer clip which is selectively engageable with the top surface of at least one of the key switches, for retaining the torsion bar body in movable proximity with the top surface of the at least one of the key switches; and at least one opening in the top surface of the at least one of the key switches for selectively engaging the torsion bar retainer clip with the at least one of the key switches which opening is symmetric with respect to a diagonal line intersecting opposite corners of each of the key switch top surfaces so that the torsion bar can be oriented horizontally or vertically on the keyboard.

2. A reconfigurable keyboard, comprising:

at least two key switches each including a plunger housing;

a key cap selectively engageable with the at least two key switches, having at least one dimension sufficient to span the at least two key switches, including one active switch post including a plunger which is reciprocally movable in the plunger housing of a first key switch for actuating said first key switch, and at least one passive switch post, which is reciprocally movable in the plunger housing of a second key switch without actuating said second key switch;

a torsion bar pivotally connected to the key cap;

a torsion bar retainer clip which is selectively engageable with a top surface of at least one of the key switches, for retaining the torsion bar body in movable proximity with the top surface of the at least one of the key switches; and at least one opening in the top surface of the at least one of the key switches for selectively engaging the torsion bar retainer clip with the at least one of the key switches, in which the at least one opening for retaining the torsion bar retainer clip is symmetric with respect to a diagonal line intersecting opposite corners of each of the key switch top surfaces so that the torsion bar can be oriented horizontally or vertically on the keyboard.

3. The keyboard of claim 2 in which each of the at least one opening is a slot having a longitudinal axis parallel to a line tangent to the plunger housing on each of the key switches.

4. A reconfigurable keyboard, comprising:

at least two key switches, each of which includes a plunger housing projecting from a top surface of each of the key switches and an opening in each corner of the top surface of each of the key switches, each opening being symmetric to a diagonal line intersecting opposing corners of the surface;

a key cap selectively engageable with the at least two key switches, having at least one dimension sufficient to span the at least two key switches, including one active switch post and at least one passive switch post each of which is reciprocally movable in one plunger housing;

a plunger connected to the active switch post which is reciprocally movable in the plunger housing of a first key switch for actuating the first key switch;

a torsion bar pivotally connected to the key cap; and a torsion bar retainer clip including two opposed ends each of which is selectively engageable with one opening in each of the top surface, and a body portion transversely disposed therebetween, for retaining the torsion bar in movable proximity with each of the top switch surfaces.

5. The keyboard of claim 4 in which each of the openings is a slot having a longitudinal axis parallel to a line tangent to the plunger housing on each key switch.

6. The keyboard of claim 4 in which each plunger housing comprises a truncated cone having a cylindrical inside wall and a sidewall and at least one groove in the sidewall, further in which the plunger includes at least one rib for slidably engaging the groove.

7. The keyboard of claim 6 in which the at least one groove has a detent in a portion thereof; and the at least one rib has a wing in a portion thereof for engaging the detent.

8. The keyboard of claim 7 in which the at least one groove and the at least one rib, respectively, comprise a corresponding plurality of grooves and ribs which are each located in the housing and on the plunger, respectively, at 90° intervals from a neighboring groove and rib.

* * * * *

UNITED STATES PATENT AND TRADEMARK OFFICE

CERTIFICATE OF CORRECTION

PATENT NO. : 5,668,358

DATED : September 16, 1997

INVENTOR(S) : Paul Charles Wolf and Raymond John Stein

It is certified that error appears in the above-indentified patent and that said Letters Patent is hereby corrected as shown below:

Title page, Item [73],

Assignee: Change "Rechnology" to -- Technology --.

Signed and Sealed this

Thirtieth Day of December, 1997

Bruce Lehman

*Attest:*

BRUCE LEHMAN

*Attesting Officer*

*Commissioner of Patents and Trademarks*